United States Patent [19]

Kitadate et al.

[11] 4,384,360

[45] May 17, 1983

[54] X-RAY APPARATUS

[75] Inventors: Kenichiro Kitadate, Higashimurayama; Yoshinori Tanimoto; Hirosi Mizuguti, both of Hachioji, all of Japan

[73] Assignee: Tokyo Shibaura Denki Kabushiki Kaisha, Kawasaki, Japan

[21] Appl. No.: 258,057

[22] Filed: Apr. 28, 1981

Related U.S. Application Data

[63] Continuation of Ser. No. 70,682, Aug. 29, 1979, abandoned.

[30] Foreign Application Priority Data

Sep. 12, 1978 [JP] Japan ..... 53-111307

[51] Int. Cl.[3] ..... H05G 1/02

[52] U.S. Cl. ..... 378/202; 378/199

[58] Field of Search ..... 250/419, 420, 421, 520

[56] References Cited

U.S. PATENT DOCUMENTS

| | | | |
|---|---|---|---|
| 1,992,335 | 2/1935 | Tietig | 250/420 |
| 2,019,602 | 11/1935 | Findlay | 250/419 |
| 2,344,543 | 3/1944 | Findlay | 250/419 |
| 2,548,489 | 4/1951 | Morrison | 250/421 |
| 2,756,368 | 7/1956 | Gross | 250/419 |

*Primary Examiner*—Craig E. Church

*Attorney, Agent, or Firm*—Oblon, Fisher, Spivak, McClelland & Maier

[57] ABSTRACT

An X-ray apparatus comprising a casing filled with an insulating gas, a high voltage transformer in said casing, an X-ray tube mounted to said casing and connected to said transformer, an X-ray shielding member attached to the wall of said X-ray tube and defining a window through which the X-rays radially emitted by said X-ray tube are released in a predetermined direction, and means defining an X-ray path through which said X-rays released through said window of said X-ray shielding member are directed so as not to be radiated on said insulating gas, whereby a reduction of the dielectric strength is prevented and the cooling efficiency is improved.

19 Claims, 27 Drawing Figures

X-RAY APPARATUS

This is a continuation of application Ser. No. 070,682 filed Aug. 29, 1979, now abandoned.

BACKGROUND OF THE INVENTION

This invention relates to an X-ray apparatus, and more particularly, to a portable X-ray apparatus which is industrially used in, for example, the inspection of welded materials.

This kind of apparatus is usually used under difficult conditions involving poor scaffolding or work at a height during, for example, the installation of a pipeline or the welding job on an oil or gas tank. Thus, the apparatus is required to be small-sized, of compact construction, and easy and reliable in operation.

In this connection, it has been proposed to change an insulating filling from an oil to a gas which is lighter in weight, or have the heat generating part of an X-ray tube project outwardly of its casing in order to obtain an improved cooling efficiency. None of these proposals have, however, proven satisfactory in practice.

SUMMARY OF THE INVENTION

It is an object of this invention to provide a small, compact and operationally reliable X-ray apparatus having a high dielectric strength.

It is another object of this invention to provide an X-ray apparatus including means defining an X-ray path through which the X-rays released from an X-ray tube in an insulating gas-filled casing are directed outwardly of the casing without being radiated on the insulating gas, and of which the dielectric strength is kept from dropping.

It is still another object of this invention to provide an X-ray tube suited for mounting a dividing cylinder forming a part of the means defining an X-ray path.

It is a further object of this invention to provide an X-ray apparatus which includes an X-ray tube having an anode projecting outwardly of a casing in order to improve the cooling efficiency of the anode and accomplish a simplified X-ray shielding construction.

It is a still further object of this invention to provide an X-ray apparatus which is small-sized, of compact construction and has a high dielectric strength with an improved high voltage transformer mounted in a casing.

These objects are attained by this invention which provides an X-ray apparatus comprising a casing filled with an insulating gas, a high voltage transformer mounted in the casing, an X-ray tube connected to the transformer and mounted in the casing, an X-ray shielding member provided in the wall of the X-ray tube to define a window through which to emit in a predetermined direction X-rays released radially from the X-ray tube, and means for defining an X-ray path through which the X-rays emitted through the window of the X-ray shielding member are directed outwardly so as not to be radiated on the insulating gas.

BRIEF DESCRIPTION OF THE DRAWINGS

Several embodiments of this invention are illustrated in the accompanying drawings.

FIGS. 11(*a*) and (*b*) are front elevational and cross-sectional views, respectively, of the casing. FIGS. 12(*a*) and (*b*) are front elevational and partial cross-sectional views, respectively, of the X-ray tube. FIG. 13 is a cross-sectional view of the X-ray tube. FIGS. 14 through 18 show a cooling fin. FIG. 14 is a side elevational view, partly in section, of the cooling fin. FIG. 15 shows the cooling fin as viewed in the direction of an arrow A′ in FIG. 14. FIG. 16 shows the cooling fin as viewed in the direction of an arrow B′ in FIG. 14 and partly in section.

FIG. 17 is a view taken along the lines H-D-E-G of FIG. 16. FIG. 10 is a longitudinal sectional view taken along the lines F-E-G of FIG. 16, and FIGS. 9 and 14 are longitudinal sectional views taken along the lines A-B-C-E-D of FIG. 16. FIG. 18 is a rear view of the boss.

DESCRIPTION OF THE PREFERRED EMBODIMENT

Figure 1:
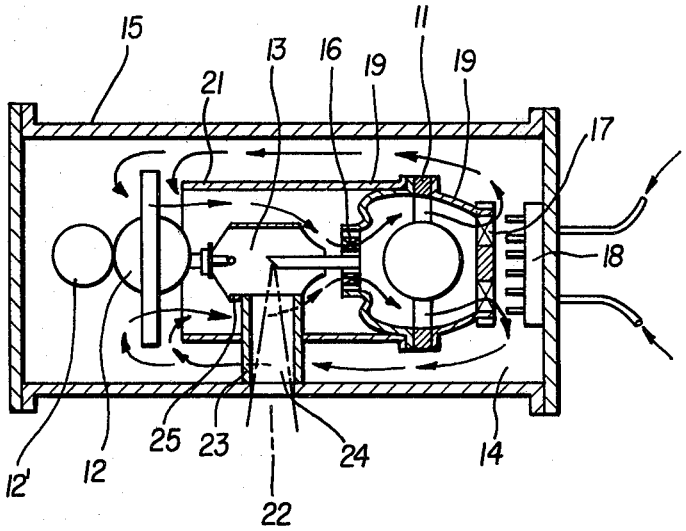
FIGS. 1 through 3 are cross-sectional views showing respectively different forms of means for defining X-ray paths.

Referring to FIG. 1, there is shown an embodiment of this invention which eliminates the following drawbacks of the X-ray apparatus of the type having a high voltage transformer and an X-ray tube in a casing filled with an insulating gas which is circulated to cool the various parts of the apparatus. According to the conventional X-ray apparatus of this type, X-rays are directly radiated on the insulating gas being circulated and ionize it. As the ionized gas is circulated, it charges the inner surfaces of the high tension coil and the insulating holder of the low tension side transformer with electricity and lowers their dielectric strength. X-rays also decompose $SF_6$ used as the insulating gas and the resulting product adheres to the surfaces of the electrodes and the insulating materials thereby lowering their dielectric strength.

Such direct exposure of the circulating $SF_6$ gas to X-rays shortens its life as an insulator against X-ray radiation, and the influence exerted by X-ray radiation becomes more distinct with an increase of the speed and flow rate of gas circulation.

The embodiment which is going to be described in detail is proposed, in view of the aforementioned drawbacks of the conventional apparatus, to provide an X-ray apparatus provided in its casing with a cylindrical dividing member made of an insulating material and forming an X-ray path defining means separating the region in which X-rays are released from an X-ray tube, from the remaining space of the casing, whereby the insulating gas circulated in the casing is protected from direct exposure to X-ray radiation.

As shown in FIG. 1, the apparatus comprises a hermetically sealed casing 15 enclosing two high voltage transformers 11 and 12, and an X-ray tube 13, and filled with an insulating gas 14. The X-ray tube 13 is of the neutral grounding type.

The casing 15 also encloses a radiator 16 fitted on the X-ray tube, a fan 17 for circulating the insulating gas 14 to cool the interior of the casing 15, a cooler 18, an insulating holder 19 for the transformer 11, and a cylindrical guide member 21 forming a circulatory path for the insulating gas 14. Numeral 12' indicates a filament transformer for the filament of the X-ray tube 13. The cooler 18 utilizes oil, water or the like from an external source of supply for the purpose of heat exchange.

The casing 15 further includes a cylindrical dividing member 23 made of an insulating material and disposed between the X-ray tube 13 and the inner surface of the casing 15 so as not to close an X-ray emission port 22 shown in broken lines, but to separate the inner space of the member 23 from the remaining part of the casing 15. The cylindrical dividing member 23 separates an insulating gas 24, such as $SF_6$, therein from the insulating gas 14 being circulated through the casing 15. An X-ray shielding member 25 is attached to the outer wall of the X-ray tube 13 to restrict the angle of outward radiation of X-rays through the X-ray emission port 22.

Thus, the X-ray apparatus can maintain a sufficiently high dielectric strength, since the insulating gas 14 circulated for cooling the anode of the X-ray tube 13 is not affected by X-rays as opposed to the conventional apparatus. In other words, as the insulating gas 24 ionized or decomposed by X-ray radiation does not flow into the rooms of the high voltage transformers 11 and 12, there does not occur any electrification or any adherence of the decomposition product to the surface of the insulating materials, but sufficient insulation can be maintained.

Figure 2:
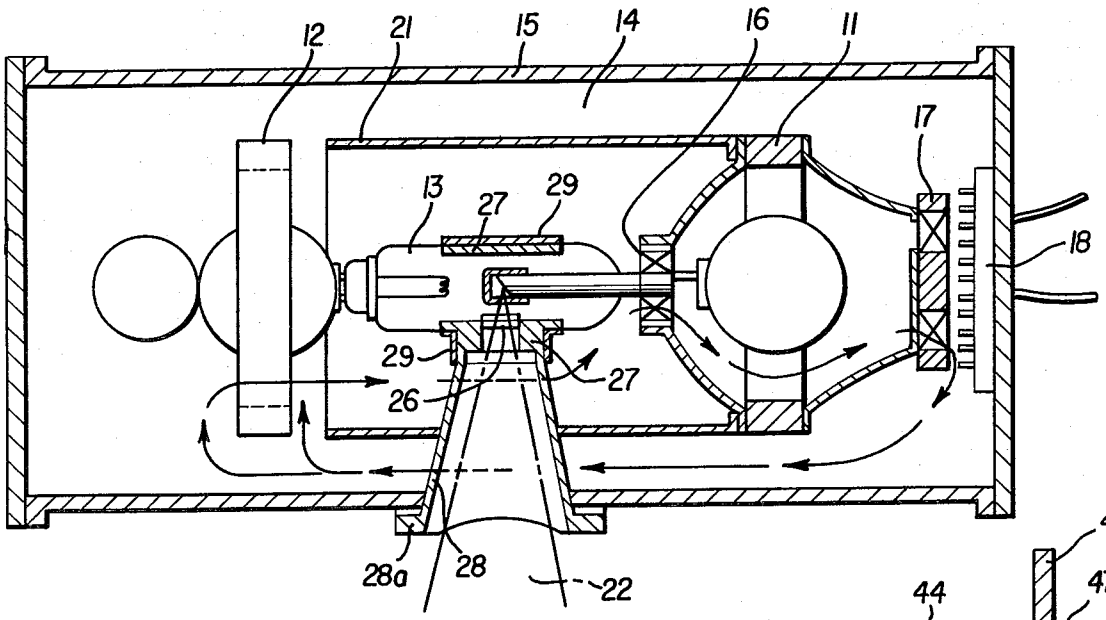

Alternatively, an arrangement as shown in FIG. 2 may be adopted in view of the neutral grounding system of the X-ray tube. Since the mid-portion of the X-ray tube 13 has a zero potential, the X-ray outlet 26 of the X-ray tube 13 may be surrounded by a metallic member 27 and a hollow, generally cylindrical dividing member 28 may be connected to the metallic member 27 so as not to close the X-ray emission port 22. The members 27 and 28 may form a unitary structure as shown. The dividing member 28 projects outwardly of the casing 15 and has a radially outwardly extending flange **28*a* secured to the casing 15**.

Thus, this arrangement also prevents the insulating gas 14 being circulated from flowing into the X-ray emission port 22 and being affected by X-rays.

In FIG. 2, a member 29 of lead is secured to the metallic member 27 and the dividing member 28. Thus, the wall of the X-ray tube 13 prevents scattering of X-rays, so that the member 29 requires only a very small amount of lead as compared with the amount of lead conventionally required for the inner wall of the casing 15. This fact contributes to the manufacture of a lighter-weight X-ray apparatus.

Figure 3:
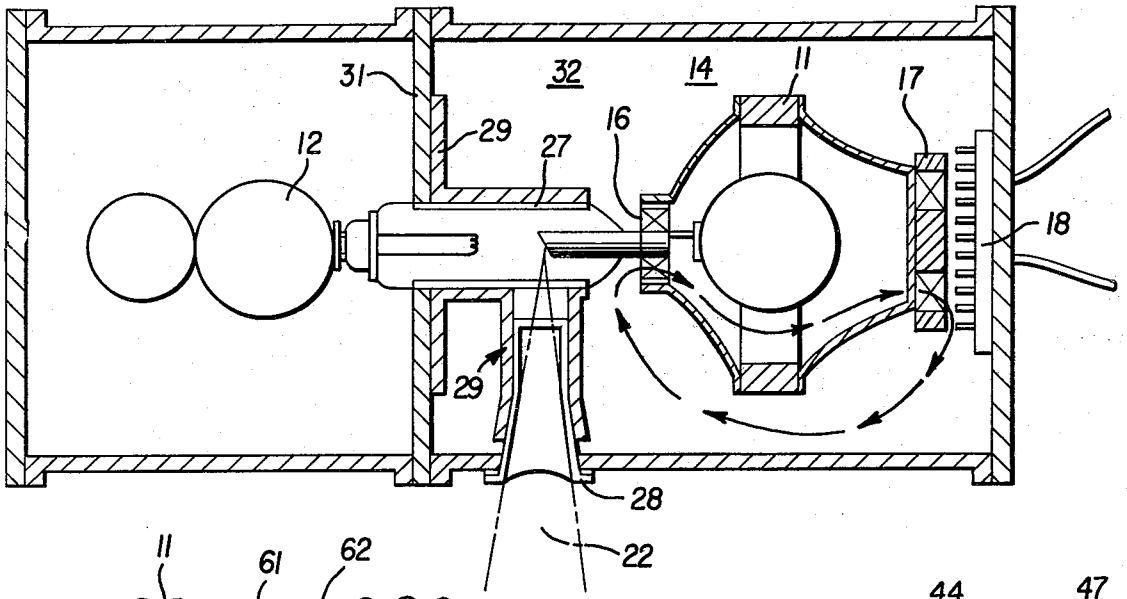

In the arrangements shown in FIGS. 1 and 2, the guide member 21 is provided to circulate to the high voltage transformer 12 the insulating gas 14 which has absorbed the heat of the anode through the radiator 16 and been cooled through the fan 17 and the cooler 18, but the guide member 21 may be omitted. More specifically stated, as the high voltage transformer 12 generates a very small amount of heat as compared with the heat generated by the X-ray tube 13, a partition wall 31 may be provided in the casing 15 to divide the casing into two sections or rooms located on the anode and cathode sides, respectively, of the X-ray tube 13 as shown in FIG. 3, and only the section 32 on the anode side of the X-ray tube 13 may be cooled. The partition wall 31 does not necessarily need to be hermetically sealed, but can be very simple without involving any problem.

Thus, as the neutral grounding system enables the use of a metallic member for the mid-portion or the X-ray outlet of the X-ray tube 13, it is not only possible to facilitate the mounting of a cylindrical dividing member to isolate the X-ray emission port 22 from any other portion of the casing 15, but the metallic member also facilitates the retention of the X-ray tube 13 per se and the attachment of the lead member 29 for shielding the X-rays. According to the arrangement of FIG. 3, the lead shielding member extends to the supporting wall as shown. Like numerals indicate like parts throughout FIGS. 1 through 3.

According to the embodiments constructed as described above, it is advantageously possible to select the circulating speed and flow rate of the insulating gas as desired to obtain an optimum cooling efficiency for the apparatus, since the insulating gas can be circulated without lowering the dielectric strength of the apparatus.

Reference is now made to FIGS. 4 through 8 for description of examples of an X-ray tube adapted for mounting a cylindrical dividing member forming the means for defining an X-ray path as described above.

Figure 4:
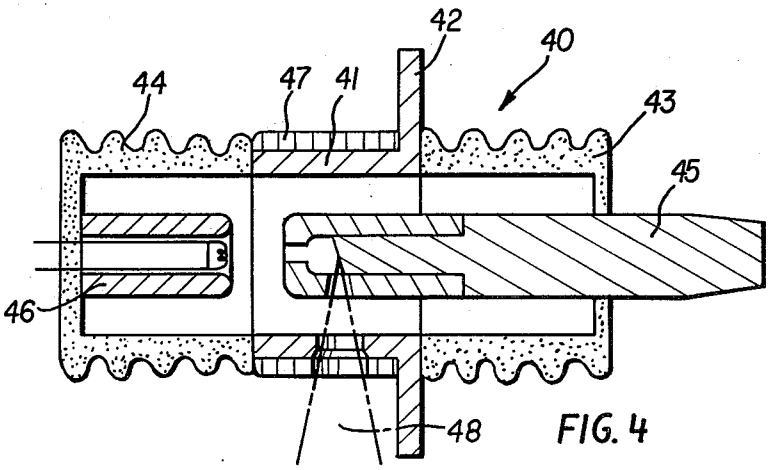

Referring to FIG. 4, there is shown an X-ray tube 40 which is suitable for use with the apparatus shown in FIG. 3 and has a central cylindrical metal member 41 provided with a radially outwardly extending flange 42 lying in a plane perpendicular to the longitudinal axis of the X-ray tube. The flange 42 is placed on the dividing wall 31 and connected thereto. A pair of cylindrical insulators 43 and 44 of ceramic or like material are secured coaxially to the opposite ends, respectively, of the cylindrical metal member 41. The insulators 43 and 44 enclose an anode 45 and a cathode 46, respectively, which face each other in the X-ray tube. The cylindrical metal member 41 and the insulators 43 and 44 are hermetically sealed to define a vacuum interior. The cylindrical metal member 41 is surrounded, except for an X-ray emission port 48, by a tube of lead 47 which serves as an X-ray shielding element.

Figure 5:
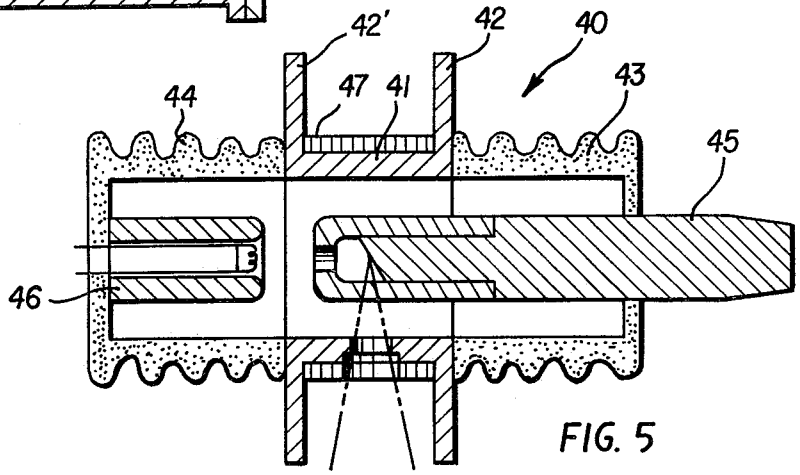
FIGS. 4 through 8 are cross-sectional views showing wholly or partly different forms of X-ray tubes adapted for mounting different means for defining X-ray paths.
Figure 6:
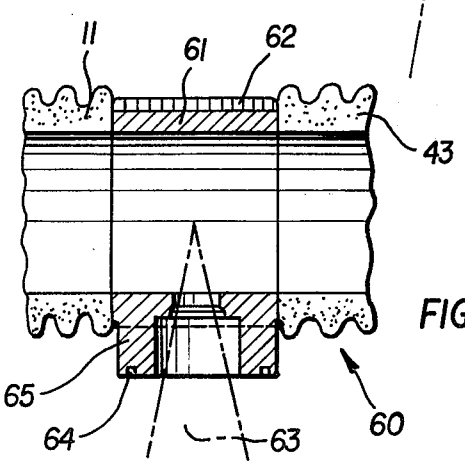

The arrangement described above permits easy attachment of the dividing wall 31 and mechanically rigid construction of the cylindrical dividing member 28. Further, the provision of the lead 47 around the outer periphery of the X-ray tube produces a satisfactory X-ray shielding effect with a very small amount of lead and therefore contributes to reducing the weight of the apparatus, as opposed to the conventional arrangement in which lead is carried on the inner surface of the wall of the casing 15. An additional flange 42' may be provided at the end of the cylindrical metal member 41 closer to the cathode 46 as shown in FIG. 5. FIG. 6 shows an X-ray tube 60 which is suitable for use with an X-ray apparatus having a cylindrical dividing member of the type shown at 28 in FIG. 2. The X-ray tube 60 includes a central cylindrical metal member 61, a member of lead 62 attached to the outer periphery thereof, and a flange 65 surrounding an X-ray emission port 63 and having an outer surface formed with an O-ring groove 64. The aforementioned cylindrical dividing member 28 is connected in a gas-tight fashion to the surface in which the O-ring groove 64 is formed.

Figure 7:
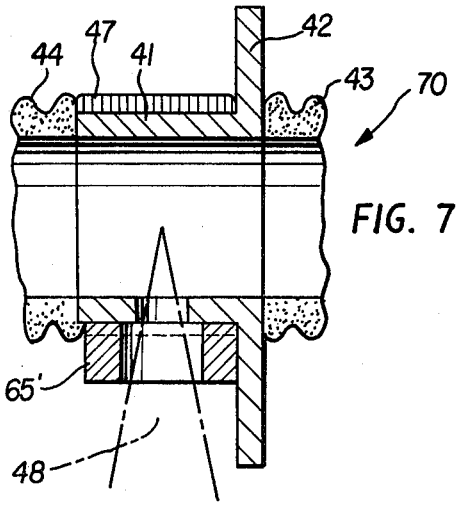
Figure 8:
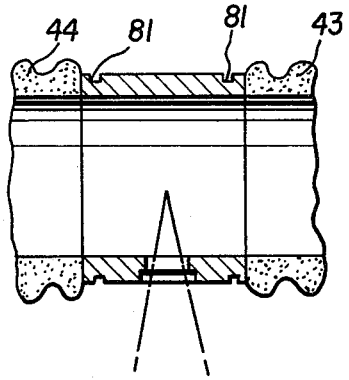
Figure 18:
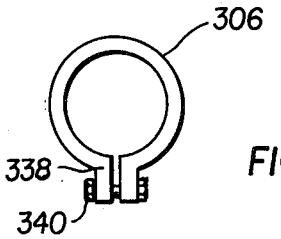
Figure 9:
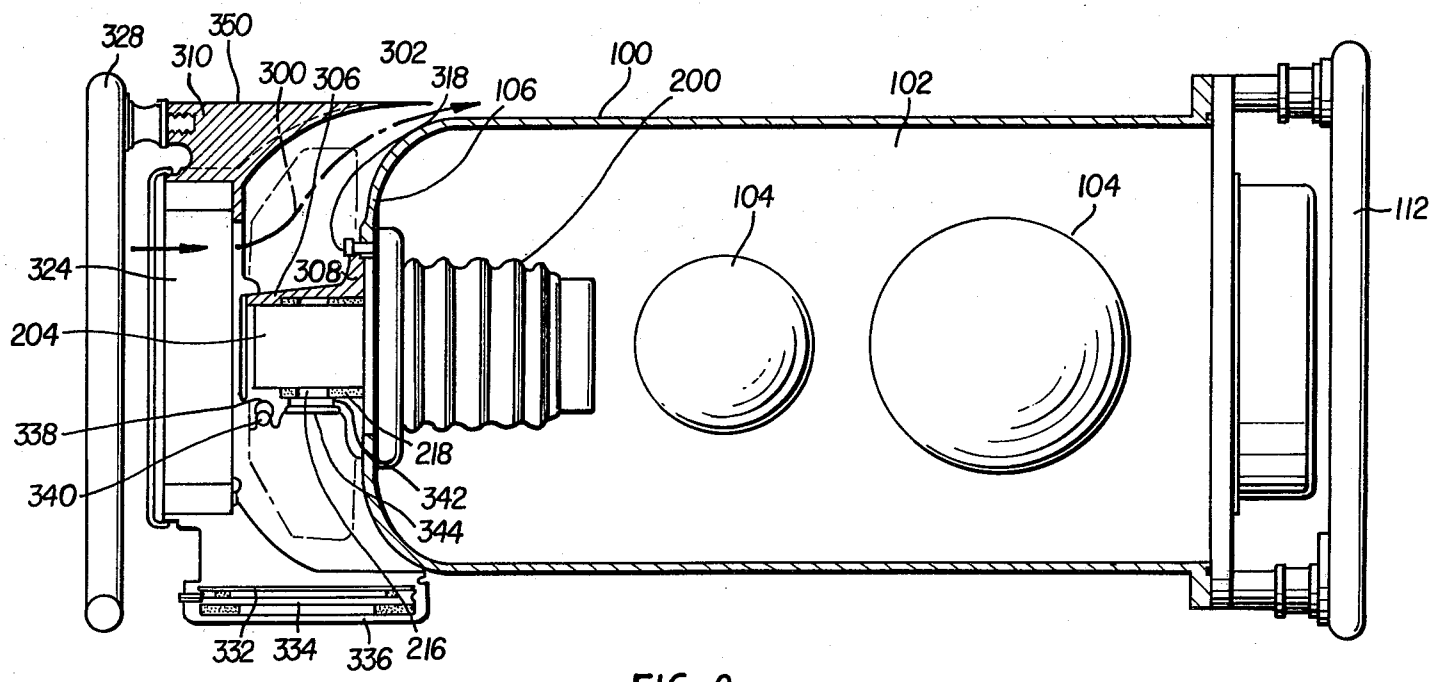
FIGS. 9 and 10 are cross-sectional views taken along different lines of an X-ray apparatus provided with an X-ray tube having an anode projecting outwardly of a casing.
Figure 10:
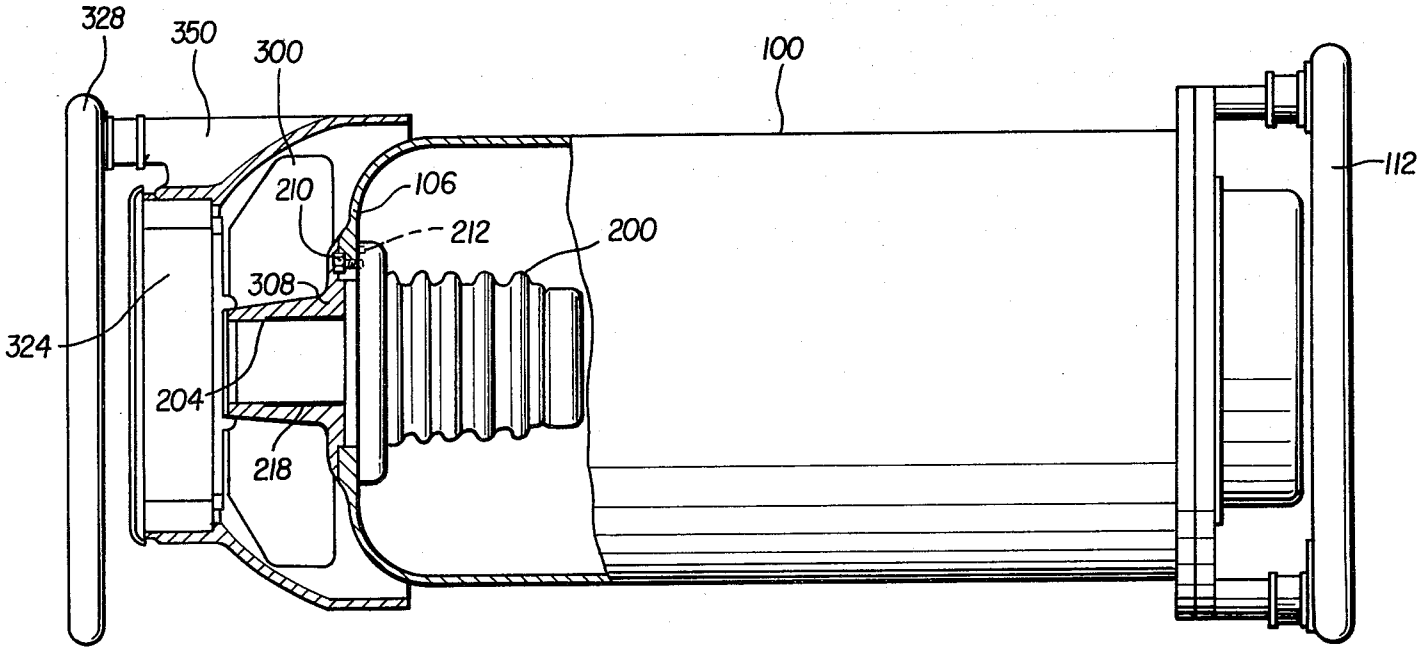

FIG. 7 shows an X-ray tube 70 which is a modification to the X-ray tube 40 of FIG. 4 and provided with a flange 65' which is similar to what is shown in FIG. 6. FIG. 8 shows a further modification in which packing grooves 81 are provided in the outer peripheral surface of the cylindrical metal member.

The various arrangements described above make it advantageously possible to connect a cylindrical dividing member to the mid-portion of an X-ray tube.

As opposed to the preceding examples of the X-ray apparatus employing an X-ray tube of the neutral grounding type, the following description covers examples of the apparatus provided with an X-ray tube of the anode grounding type.

This invention as embodied in these examples provides a small-sized, lightweight X-ray apparatus in which the anode portion of an X-ray tube projects outwardly of a casing and is efficiently cooled.

Attention is directed to FIGS. 9 through 18. Description is first made of an outline of the construction of the entire apparatus with reference to FIGS. 9 through 12. According to the embodiment shown in these drawings, the apparatus comprises a cylindrical casing 100, an X-ray tube 200 connected to the casing 100 and having an anode portion projecting outwardly therefrom, and a cooling device 350 for cooling a cooling fin 300 for the anode portion of the X-ray tube 200.

Figure 11B:
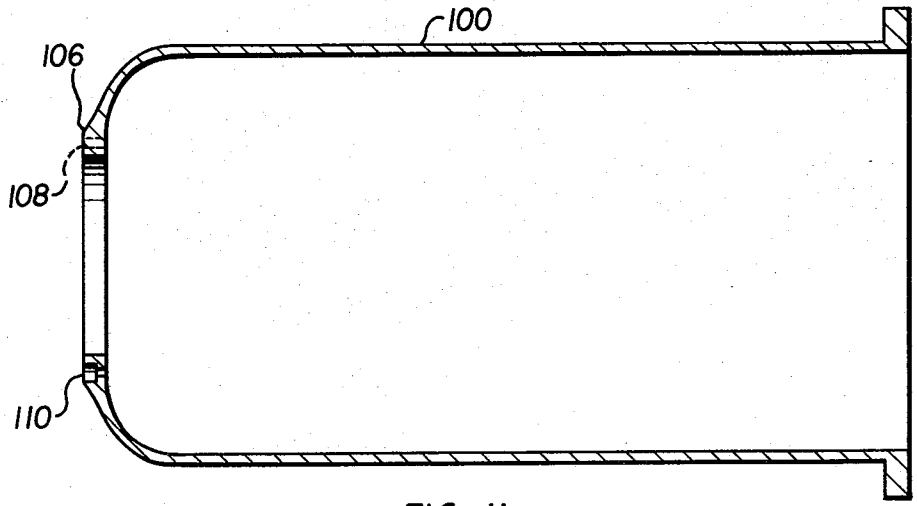
Figure 11A:
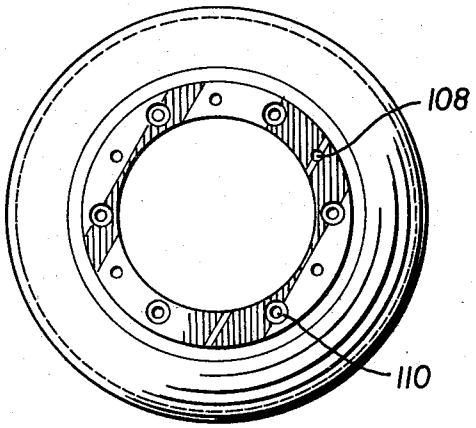

The casing 100 is filled with an insulating $SF_6$ gas 102 and encloses a pair of high voltage transformers 104. The casing 100 has a flange 106 which is provided with five threaded holes 108 for mounting a cooling fan and six holes 110 for mounting the X-ray tube as shown in FIGS. 11(*a*) and (*b*). The casing 100 is further provided with a guard ring 112 at its bottom.

Figure 12B:
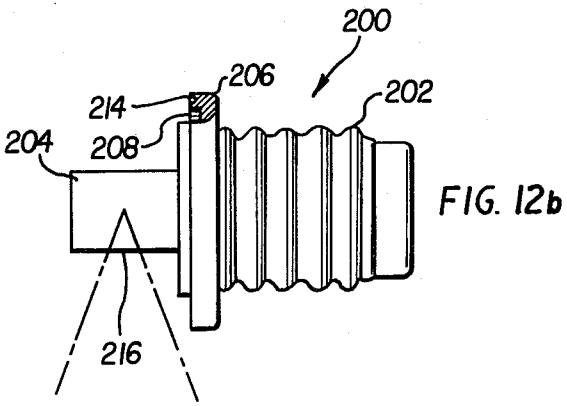
Figure 12A:
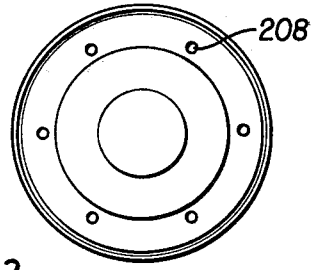
Figure 15:
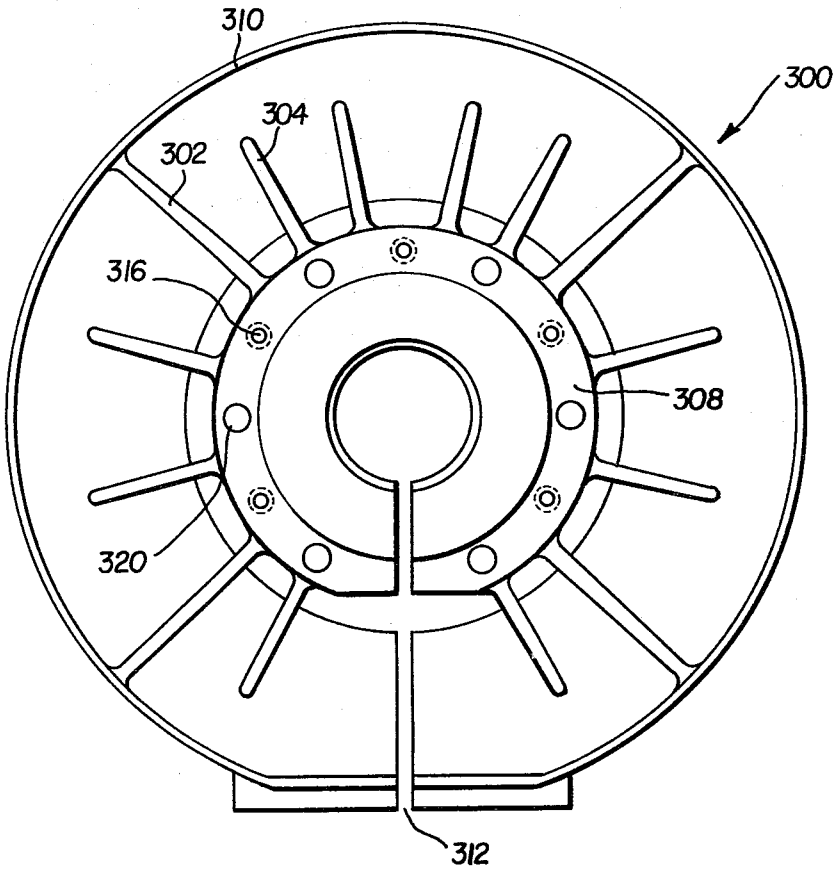
Figure 14:
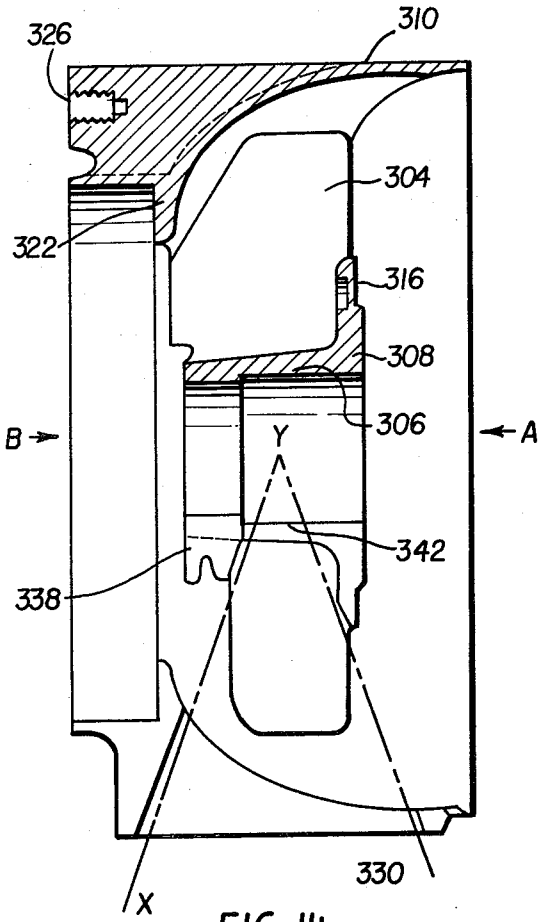
Figure 17:
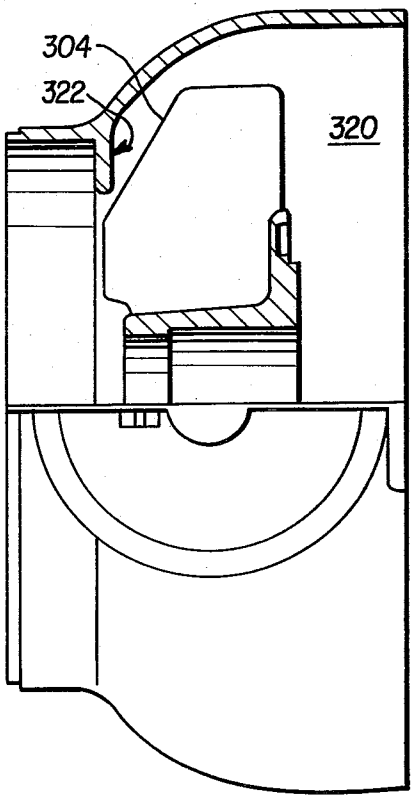
Figure 16:
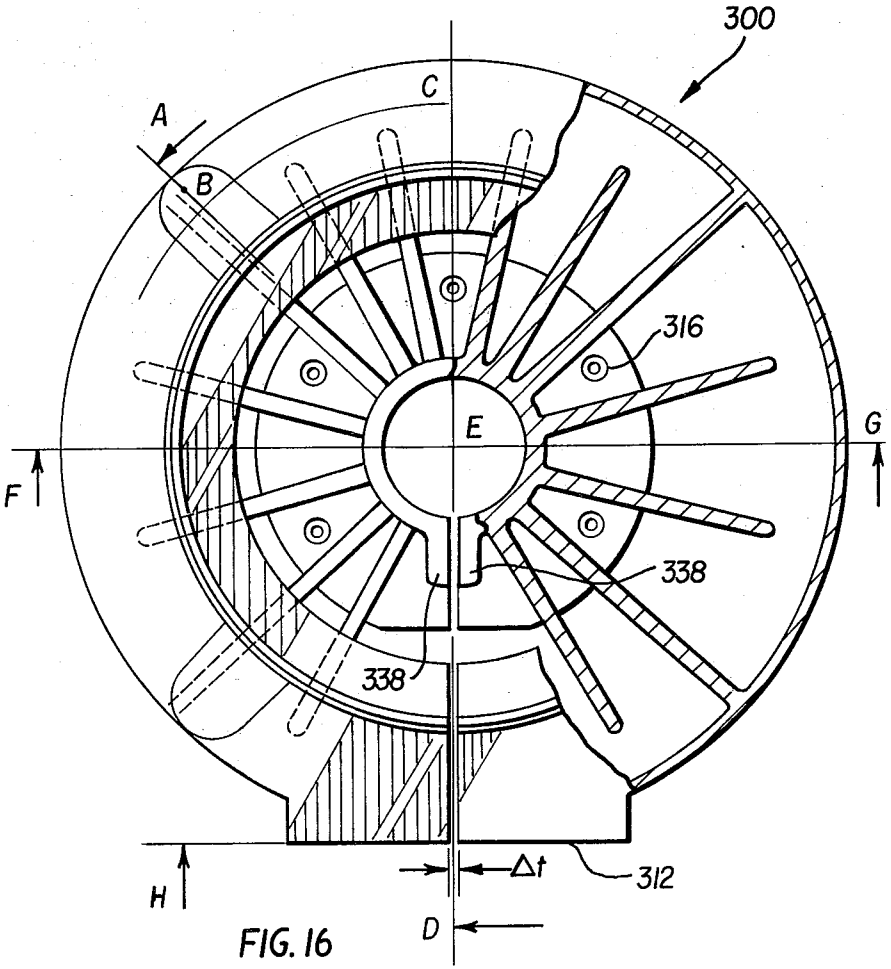

The X-ray tube 200 is connected to the flange 106 of the casing 100. The X-ray tube 200 comprises a cathode portion 202 formed from a ceramic insulator tube, a radially outwardly projecting flange 206 and an anode portion 204 formed from a ceramic insulator tube, as shown in FIGS. 12(*a*) and (*b*). The flange 206 is provided with an equal plurality of threaded holes 208 corresponding to the mounting holes 110 in the flanges 106 of the casing 100. The flange 206 is tightly secured to the flange 106 by bolts 210 passing through the holes 110 and 208. The flange 206 is formed with an annular groove 214 (FIG. 12) in which a seal ring 212 (FIG. 10) is placed. Thus, as the bolts 210 are tightened to put the two flanges 106 and 206 closely together, the casing 100 is completely sealed against leakage of the insulating $SF_6$ gas 102. The anode portion 204 is provided with an X-ray emission window 216, and is surrounded by an X-ray shielding member 218 except for the window 216.

Figure 13:
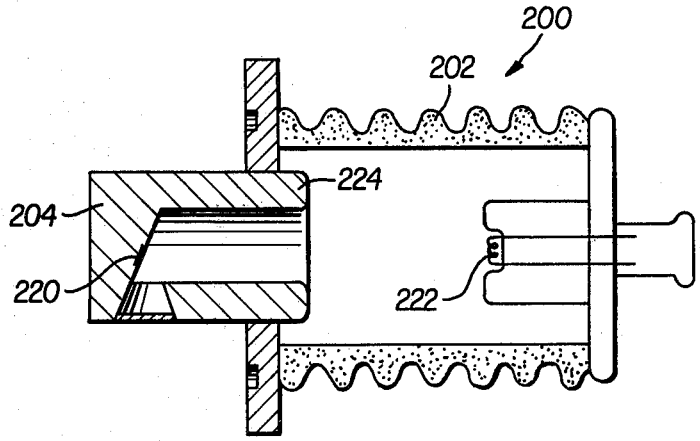
FIGS. 11 through 18 are detailed views of different parts of the apparatus shown in FIGS. 9 and 10.

As shown in FIG. 13, the anode portion 204 of the X-ray tube 200 is cylindrical and closed at one end, and a target 220 is obliquely positioned on the inner surface of its closed end. The opposite end 224 of the anode portion 204, which is open toward a cathode 222, extends into the cathode portion 202 in order to minimize the amount of X-rays radiated by the target 220 into the interior of the casing 100.

The anode portion 204 of the X-ray tube 200 is further provided with a cooling fin device 300 as shown in FIGS. 14 through 18. The cooling fin device 300 comprises a plurality of each of long fins 302 and short fins 304, a boss 306 from which the fins 302 and 304 extend radially outwardly, an annular flange 308 which is integral with the boss 306, and an outer frame 110 integrally connected with the fins 302. The cooling fin device 300 is provided with a longitudinally extending slit 312. The boss 306 includes a portion having a slightly greater inside diameter than the outside diameter of the anode portion 204 of the X-ray tube 200, and a portion having a slightly greater inside diameter than the outside diameter of the X-ray shielding member 218. The flange 308 extends radially outwardly from the boss 306 and lies in a plane which is perpendicular to the longitudinal axis of the boss 306.

The flange 308 is provided with five mounting holes 316 which correspond to the threaded holes 108 formed in the flange 106 of the casing 100. Bolts 318 pass through the holes 316 and 108 and are tightened to secure the flange 308 to the flange 106. The flange 308 is further provided with a plurality of recesses 320 positioned alternately with the mounting holes 316 to accommodate the bolts 210 by which the X-ray tube 200 is secured to the casing 100.

The outer frame 310 has an inside diameter which is greater than the outside diameter of the casing 100, and defines an opening for ventilation with the outer wall of the casing 100. The outer frame 310 has a mounting seat 322 on which an air blower 324 is mounted, and a mounting hole 326 with which a guard ring 328 is connected. The outer frame 310 is further provided with an X-ray emission port 330, and a filter 332, a throttle 334 and a centering plate 336 are provided in this order outwardly of the X-ray emission port 330.

The boss 306 is formed with a pair of oppositely disposed tightening lugs 338 between which the slit 312 is located. The distance between the lugs 338 is narrowed by tightening a bolt 340, whereby the inner surface of the boss 306 is maintained in intimate contact with the outer surfaces of the X-ray tube 200 and the X-ray shielding member 218 (see FIG. 18). The boss 306 is further provided with an opening 342 aligned with the X-ray emission window 216 of the X-ray tube 200. A cover 344 is placed over the opening 342 to prevent any foreign material from entering thereinto.

The arrangement as hereinabove described, in which the flanges 106, 206 and 308 of the casing 100, the X-ray tube 200 and the cooling fin device 300, respectively, are maintained in intimate contact with one another, provides an enlarged surface area of heat radiation and thereby an improved heat radiating effect. This radiating effect is further enhanced by an improved heat transfer from the anode portion 204 and the X-ray shielding member 218 of the X-ray tube 200 to the boss 306 with which they are maintained in intimate contact by narrowing the slit 312 in the cooling fin device 300.

The improved heat radiating effect protects the seal ring 212 on the casing 100 against any failure that would otherwise be caused by a high temperature prevailing in its vicinity and result in leakage of the insulating $SF_6$ gas 102, and makes it possible to form the seal ring 212 from any ordinary sealing material. Thus, it is not necessary to increase the capacity of the cooling fin device 300 or the air blower 324 in order to prevent any such failure of the seal ring 212; this assists the reduction of the overall size and weight of the apparatus.

The cooling fin device 300 permits installation of the air blower 324 and the guard ring 328 directly thereon, since it is sufficiently rigidly secured to the casing 100 with its integral flange 308 tightly fastened to the flange 106 on the latter. This arrangement simplifies or facilitates the operation of the apparatus. Moreover, the elimination of the necessity of providing the casing 100 with means for supporting the air blower 324, etc. to mount them directly on the casing 100 helps to simplify the construction of the apparatus and render it easier to manufacture.

As the outer frame 310 of the cooling fin device 300 has an inside diameter which is greater than the outside diameter of the casing 100 over which the outer frame 310 is placed, the cool air supplied through the air blower 324 passes through the clearance opening between the outer frame 310 and the casing 100, and is directed along the outer wall of the casing 100 to thereby cool the whole casing 100.

It is to be understood that the scope of this invention is not limited to the embodiment thereof as hereinabove described. For example, the number of the holes 316 and the numbers and shapes of the fins 302 and 304 are not limited to those shown, but may be changed as desired. The outer frame 310 does not necessarily have to be greater in diameter than the casing 100, if the heat radiating efficiency of the air blower 324 and the cooling fins 302 and 304 is improved.

The slit 312 in the cooling fin device 300 may be provided in a different position if the same effect as those described before can be obtained. Moreover, the slit 312 may sometimes be eliminated to form the boss 306 with a completely circular configuration inserted over the anode portion of the X-ray tube, depending on various conditions such as the heat radiating effect obtained by the intimate mutual contact of the flanges 106, 206 and 308, and the heat radiating effect by the air blower 324 and the cooling fins 302 and 304.

It is also possible to form the cooling fin device 300 only by the boss 306, the flange 308 and the fins 302 and 304, and construct the outer frame 310, the mounting seat 322 for the air blower 324 and the mounting hole 326 for the guard ring 328 independently of the cooling fin device 300.

Moreover, all of the X-ray emission port 330, the opening 342, the cover 344 and the filter 322 may be eliminated if the boss 306 of the cooling fin device 300 and that portion of the outer frame 310 which corresponds to the X-ray emission window 216 can be manufactured with accurate wall thicknesses.

In accordance with the various arrangements described above, it is possible to radiate heat efficiently and minimize the use of cooling devices, so that there can be provided a small-sized and compact X-ray apparatus which is easy to handle.

Attention is now directed to the improvements encompassed by this invention in the high voltage transformers employed in the X-ray apparatus.

Recently, there has been proposed a system in which a commercial source voltage is converted to a direct current voltage by rectification, and this voltage is converted to a pulse voltage by switching and supplied to the primary winding of a high voltage transformer to feed an X-ray tube with a tube voltage through the secondary winding of the transformer, while the inverse voltage appearing in the secondary winding is returned to the power source through a tertiary winding of the transformer.

Figure 19:
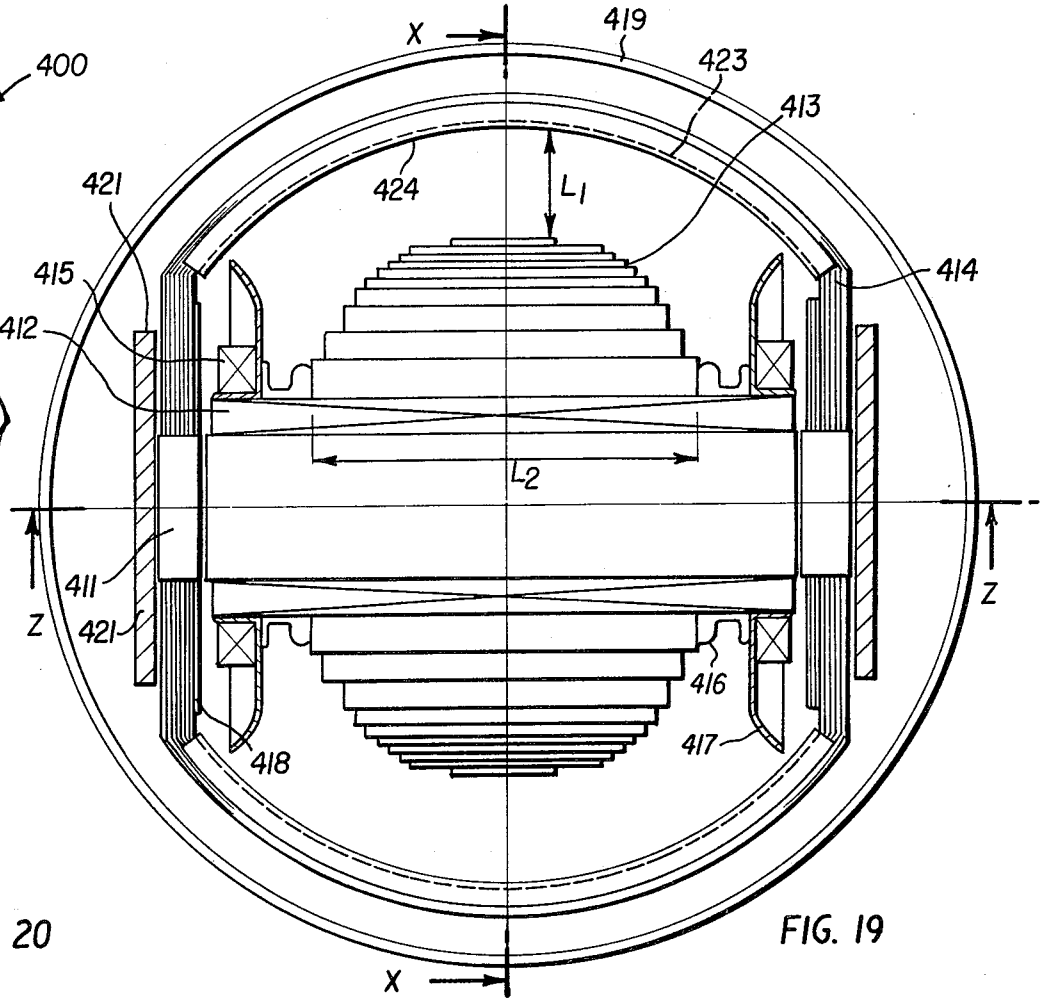
FIG. 19 is a cross-sectional view showing a high voltage transformer employed in one embodiment of this invention.
Figure 20:
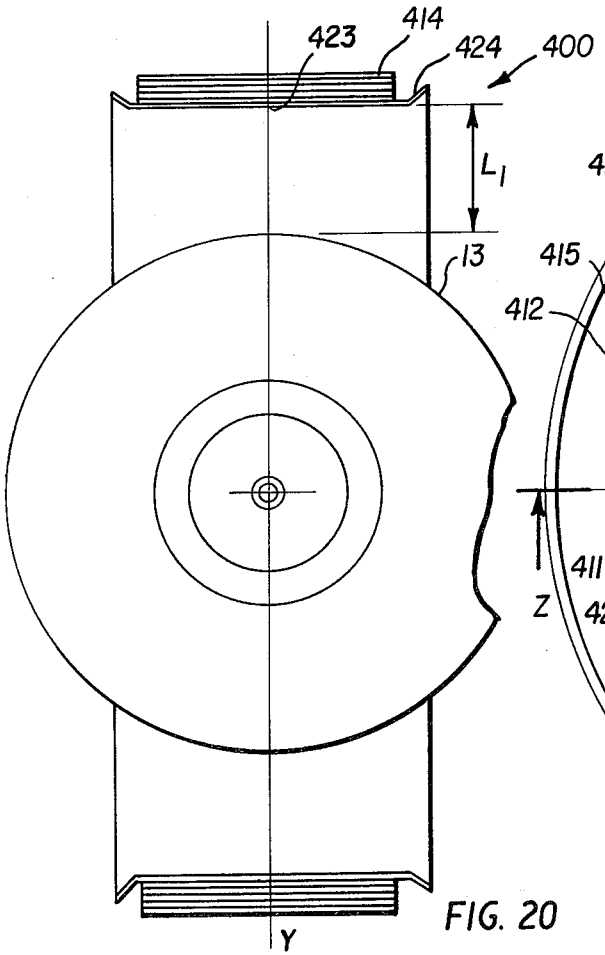
FIG. 20 is a view taken along the line X—X of FIG. 19.
Figure 21:
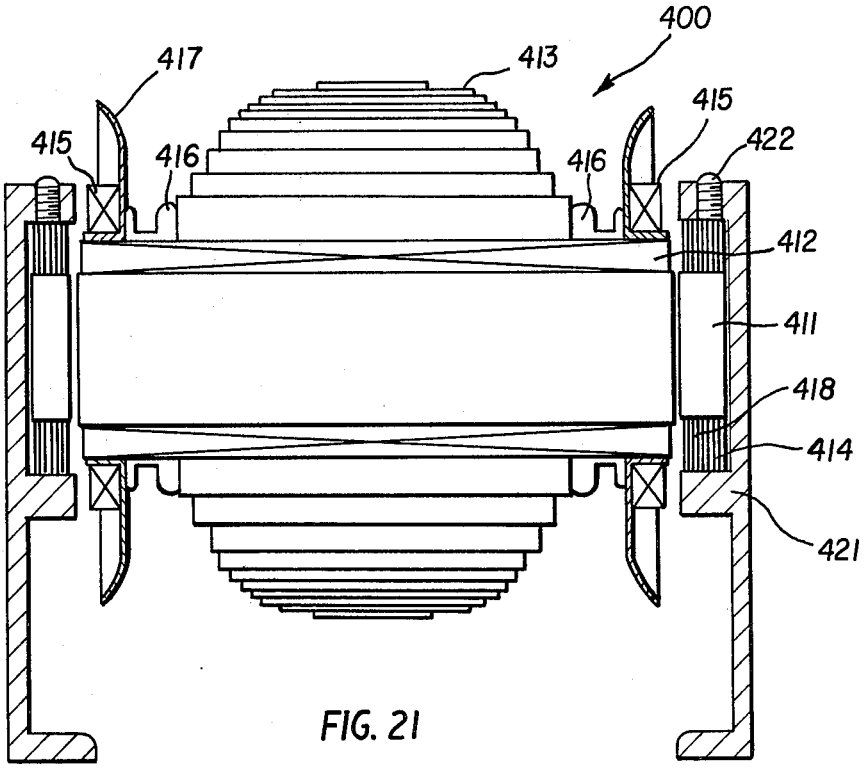
FIG. 21 is a cross-sectional view taken along the line Z—Z of FIG. 19.

FIGS. 19 through 21 show by way of example a high voltage transformer 400 having such a tertiary winding.

The transformer 400 includes a shell type iron core 411 on which a primary winding 412 and a secondary winding 413 are wound concentrically. The distance $L_1$ between the outermost turn of wire of the secondary winding 413 and a yoke 414 is determined by the output voltage and the insulating characteristics. For instance, if the output voltage is 220 kV and the dielectric strength of the insulating $SF_6$ gas is 5 kv/mm, the distance $L_1$ must be 40 mm (=200 kV/5 kV).

The maximum winding width $L_2$ of the secondary winding 413 depends on the dielectric strength between the layers. For instance, if the dielectric strength between the layers is 2,000 V and the voltage per turn of wire of the secondary winding 413 is 1.0 V, the maximum number of turns per layer is 1,000 turns (=1,000 V/1 V). If the wire has a diameter of 0.1 mm, the winding width of each layer of the coil is 100 mm (=1,000 turns×0.1 mm). If some allowance $\alpha$ is considered for the ends of the coil and the allowance $\alpha$ is 20 mm by way of example, the width $L_2$ is 120 mm ($L_2=100+\alpha$, i.e., 20).

Thus, the values $L_1$ and $L_2$ of the secondary winding 413 are determined. In order to minimize the size of the transformer under these circumstances, it is desirable to keep the diameters of the core 411, the primary winding 412 and the secondary winding 413 as small as possible.

A tertiary winding 415 is wound concentrically about the primary winding 412. The tertiary winding 415 is divided into two equal portions wound in the dead spaces at the opposite ends, respectively, of the secondary winding 413. Each portion has a half of the number n of the necessary turns of wire, and is disposed at one end of the secondary winding 413 with a spacer 416 and an equalizer 417 in between. The equalizer 417 surrounds the tertiary winding 415 to protect it against exposure to a high voltage.

Thus, as the dead spaces formed at the opposite ends of the secondary winding 413 are effectively utilized to accommodate the tertiary winding 415, whereby the weight of the entire apparatus, the size and weight of the apparatus can be effectively reduced.

The transformer 400 further includes an auxiliary core 418. As the yoke 414 has a cross-sectional area which is about ½ of that of the central core 411, the area of contact between the core 411 and the yoke 414 is reduced, and there occurs a loss to the flow of the magnetic flux. In order to eliminate any such loss by increasing the area of contact between the core 411 and the yoke 414, the auxiliary core 418 is disposed on the central core 411 inwardly of the yoke 414.

The core 411 and a casing 419 define therebetween a semicircular space in which a pair of supporting members 421 are disposed for supporting the high voltage transformer. As shown in FIG. 21, the supporting members 421 are connected to the yoke 414 by screws 422 and have a configuration adapted to hold the yoke 414 and the auxiliary core 418. FIG. 21 is a cross-sectional view taken along the line Z—Z of FIG. 19.

The iron core, which is of the split type as shown in FIG. 20, is very slightly stepped at a joint 423 between the two halves. This presents a problem in insulation against a high voltage. In view of this problem, an equalizer 424 is provided on the side of the secondary winding 413 and cooperates with the aforementioned equalizer 417 to ensure that no unevenness exist as viewed from the high voltage electrode toward the low voltage side. FIG. 20 is a cross-sectional view taken along the line X—X of FIG. 19.

The arrangement as hereinabove described assists the reduction of the size and weight of the apparatus by locating the tertiary winding 415 in the dead spaces formed at the ends of the secondary winding 413, and the supporting members 421 in the dead spaces between the central core 411 and the casing 419. The problem of insulation which might otherwise be involved in the size and weight reduction is solved by the provision of the two equalizers 417 and 424.

Although the tertiary winding 415 has been described as being of the type split into two equal portions, it is also possible to split it into any other ratio of division, or even use it without splitting it in any way whatsoever, in order to obtain an equal performance of the tertiary winding.

Alternatively, the tertiary winding 415 may be formed integrally in the same layers with the primary winding 412. This arrangement is advantageous from the standpoint of both the manufacturing work and cost owing to the reduction in the number of the parts required, though the overall size of the secondary winding 413 is diadvantageously enlarged.

While the auxiliary core 418 has been described as being positioned inwardly of the yoke 414, it can also be positioned outwardly of the yoke 414 without decreasing the aforementioned advantages. Moreover, though the foregoing description has been directed to a shell type transformer, this invention can equally be embodied in a core type transformer.

The foregoing arrangements according to this invention, thus, provides a small and lightweight high voltage transformer which is particularly suitable for use with a portable X-ray apparatus and greatly contributes to reducing its size and weight.

The X-ray apparatus of the type in which an insulating gas is circulated as shown in FIG. 1 by way of example, has always involved problems relating to the withstand voltages of the insulating materials provided therein. These problems are due to the fact that the ions produced by the X-ray ionization of the insulating gas or its decomposion when heated by the high temperature fins are carried forward with the gas being circulated and adhere to the surfaces of the insulating materials on the transformer which have a very high surface resistivity, or the friction between the insulating gas and the surfaces of the insulating materials charges those surfaces with static electricity, resulting in an increase of the potential gradient between the insulating surfaces and the earth.

In order to solve these problems, it has heretofore been proposed merely to increase the distance between the insulating surfaces and the earth. This method is, however, inappropriate for a portable X-ray apparatus, since a larger-sized high voltage transformer is necessarily required and adds much to the weight of the apparatus.

Figure 22:
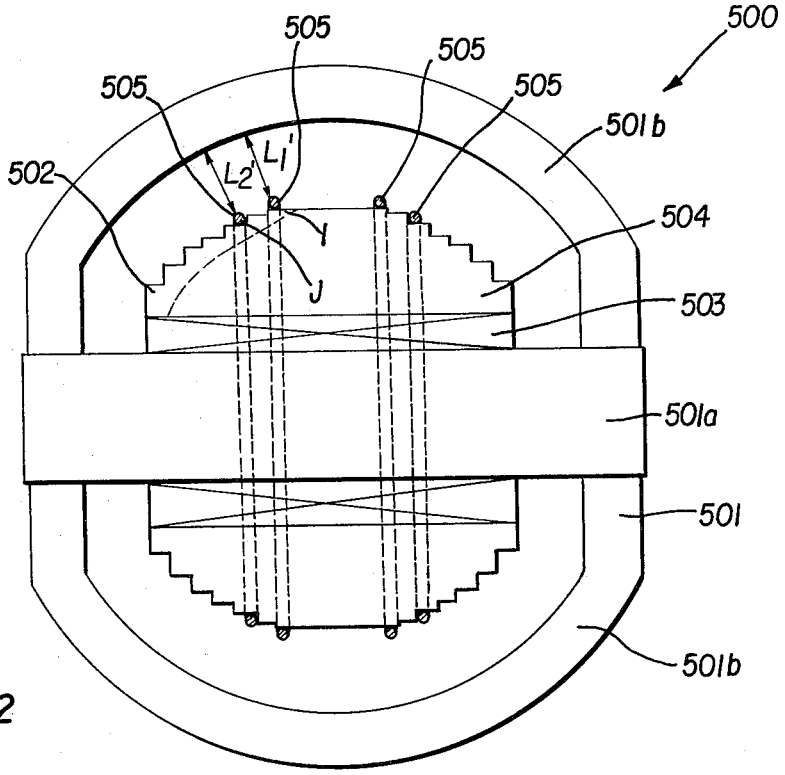
FIG. 22 is a front elevational view of a different high voltage transformer.

Referring to FIG. 22, there is shown a high voltage transformer 500 which eliminates the aforementioned disadvantages. The transformer 500 includes an iron core 501 having a central leg 501*a* about which an insulating wire and insulating paper 502 are wound to form a primary coil 503. Likewise, an insulating wire and insulating paper 502 are wound about the primary coil 503 to form a secondary coil 504. The insulating paper 502 used with the insulating wire is wound so as to project outwardly from the coils 503 and 504, and have a stepped edge configuration as shown by way of example in order to maintain the necessary insulating characteristics. The iron core 501 also has an outer leg 501*b* which constitutes the low tension side of the transformer.

According to a salient feature of this high voltage transformer, electrodes 505, consisting each of, say, a bare wire having a length short of a full turn about the coil 504, are disposed on the stepped surface of the insulating paper 502 in the same direction of winding as the coil 504, and a portion of each electrode 505 is soldered to the coil 504 as at I and J in FIG. 22, so that the electrodes 505 and the coil 504 have an equal potential.

Thus, the electric charge carried by the insulating gas is adsorbed by the electrodes 505 having an equal potential to the coil 504, and does not adhere to the surface of the insulating material having a very high surface resistivity. The ions produced by ionization of the insulating gas are attracted and absorbed by the coil. Consequently, the potential gradient existing between the outer leg 501*b* (low tension side) and the surface of the insulating gas is maintained at the same level as when no insulating gas is circulated. The diameters of the electrodes 505 positioned at the steps of the stepped surface of the secondary coil 504 reduce the distance between the coil 504 and the outer leg 501*b* as indicated at $L_1'$ and $L_2'$, but as the presence of the electrodes 505 eliminates any acute corner on the outer surface of the high tension coil 504, the electrodes 505 have the substantial gradient. Thus, this transformer arrangement can be realized without elongating the distances $L_1'$ and $L_2'$.

While in the embodiment hereinabove described, the insulating $SF_6$ gas is circulated as it is also used for the cooling purpose in the neutral grounding system, the electrodes 505 positioned on the high tension coil 504 and having an equal potential thereto are, of course, applicable to the apparatus in which the $SF_6$ gas is not used for the cooling purpose, and not only to the neutral grounding system, but also to any other grounding system. The electrodes 505 are also applicable to the system in which oil, instead of gas, is used for the insulating purpose. An equal result can be obtained from the use of an electrode having a flat cross-section lying over two or more steps on the stepped surface of the coil, instead of the electrode 505 composed of a bare wire having a circular cross-section.

According to the arrangement as hereinabove described, in which the electrodes each having a length short of a full turn about the high tension coil are wound thereabout in the same direction of winding therewith, and connected thereto so as to have an equal potential to the coil, the electric charge, if any, carried by the insulating $SF_6$ gas circulated in an X-ray apparatus by way of example is adsorbed by the electrodes, and is prevented from adhering to the projecting portions of the high tension coil or the surface of the insulating material thereon. This prevents an increase of the potential gradient between the surface of the insulating material and the outer leg, and eliminates the necessity of increasing the distance between the high and low tension sides, as opposed to the conventional arrangement. Thus, the size of a high voltage transformer can be reduced, thereby contributing to reducing the size and weight of an X-ray apparatus.

In order to reduce the size and weight of a portable X-ray apparatus, it is useful to convert a commercial source voltage to a higher frequency of, say, 200 to 300

$H_z$ for a high voltage transformer, or 10 kHz for a filament transformer, thereby reducing the cross-sectional area of the iron core of the transformer effectively to one-fourth or one-fifth.

The dielectric loss P and the insulating capacity C are expressed as:

$$P = 2\pi f C V^2 \tan \delta \quad (1)$$

and $$C = K \frac{\epsilon_s A}{t} \quad (2)$$

wherein f=frequency, V=voltage, tan δ=dielectric power factor, εs=specific inductive capacity, A=opposing area, t=insulating distance, and K=constant of proportionality.

As the dielectric loss increases if the frequency f is increased, it is necessary to reduce the capacity C in order to decrease the dielectric loss.

Figure 23:
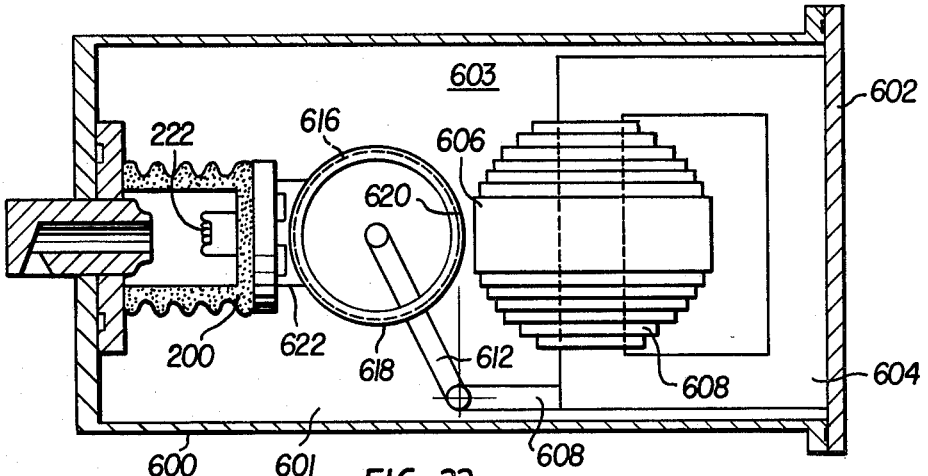
FIGS. 23 and 24 are cross-sectional views taken along different lines of an apparatus equipped with a filament transformer.
Figure 24:
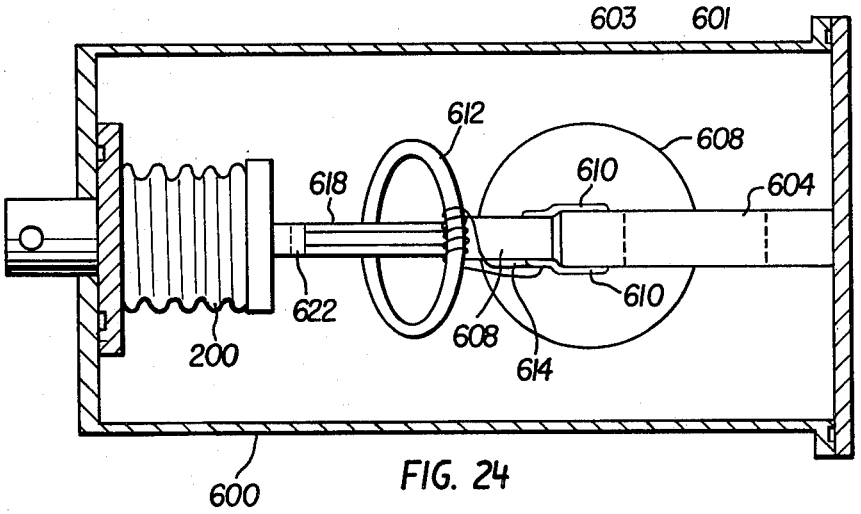

The arrangement shown in FIGS. 23 and 24 is proposed, in view of the foregoing circumstances, in order to minimize the distributed capacity of a filament transformer and obtain a lightweight and rigid transformer construction.

In order to attain these objects, the embodiment shown in FIGS. 23 and 24 provides a transformer which is an improvement in the transformer having an iron core and coils in a casing filled with an insulating gas, and which comprises a ring-shaped iron core, a primary coil wound about a portion of the core, a spool passing through the center of the ring-shaped iron core and lying in a plane perpendicular to the plane thereof, and a secondary coil wound about the spool and insulated from the iron core by the insulating gas.

Referring to FIGS. 23 and 24, there is shown a casing 600 in which the X-ray tube 200 of FIG. 13 is mounted by way of example, and which is filled with an insulating gas 601, such as $SF_6$. The casing 600 has a cover 602 to which an iron core 604 for a high voltage transformer 603 is secured. The iron core 604 has a leg remote from the cover 602 on which a coil 608 having a lead wire 606 is wound. A ring-shaped iron core 612 for a filament transformer is supported on the iron core 604 for the high voltage transformer by connecting members 609 and 610. The iron core 612 lies obliquely in a plane disposed at an angle α to a plane which is parallel to the cover 602. A primary coil 614 is wound on the iron core 612.

The iron core 612 for the primary coil and a ring-shaped spool 618 on which a secondary coil 616 is wound pass through the center of each other, and are positioned separately from each other in the planes crossing each other in mutually perpendicular relationship. Thus, the iron core 612 and the secondary coil 616 are isolated from each other by the insulating gas 601 filling the casing 600. The spool 618 is made of aluminum, plastics or other material, and comprises a pair of semicircular segments connected by an insulating spacer 620 into a circular form. The secondary coil may be secured to the anode 222 of the X-ray tube 200 by a connecting member 622, or may alternatively be secured directly to the casing 600, if the ring-shaped primary and secondary coils pass through the center of each other and lie in the planes which are perpendicular to each other.

Figure 25:
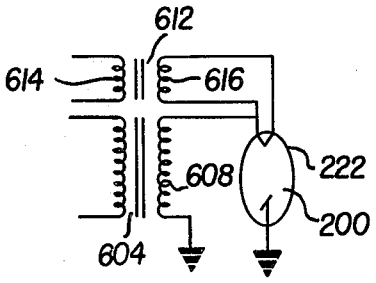
FIG. 25 is a circuit diagram.

As shown in FIG. 25, the coil 616 is electrically connected to the anode 222 of the X-ray tube 200, and the lead wire 606 of the coil 608 is electrically connected to the coil 616.

In the arrangement hereinabove described, it is also possible to make the iron core 612 of the split construction if the spool 618 is made of an insulating material and has a unitary structure.

According to the arrangement described above, in which the secondary coil is isolated from the iron core by the insulating gas, the specific inductive capacity εs in formula (2) above can be very small as compared with the conventional arrangement employing insulating paper, thereby reducing the distributed capacity of the filament transformer to an extremely low level and allowing for a lightweight and rigid transformer construction, so that there can be obtained a lightweight X-ray apparatus.

Thus, this invention provides a really useful portable X-ray apparatus which is small-sized and lightweight, and yet does not involve any problem, such as reduction in dielectric strength, that might otherwise arise from the small and lightweight construction.

What is claimed is:

1. An X-ray apparatus comprising:

a casing filled with an insulating gas, a high voltage transformer in said casing, an X-ray tube mounted to said casing within said casing and connected to said transformer, an X-ray shielding member attached to the wall of said X-ray tube and defining a window through which the X-rays radially emitted by said X-ray tube are released in a predetermined direction, means defining an X-ray path through which said X-rays released through said window of said X-ray shielding member are directed so as not to be radiated on said insulating gas, said insulating gas surrounding and insulating said high voltage transformer and said X-ray tube, said X-ray path defining means preventing ionization of said insulating gas by preventing X-rays emitted through said window from impinging on said insulating gas, and said high voltage transformer comprising a high tension coil wound in an outwardly stepped configuration toward each end thereof, insulating paper exposed on the outer surface of said coil and defining a stepped surface configuration, and a plurality of electrodes each having a length short of a full turn about said coil and wound about one stepped portion of said insulating paper, said electrodes having an equal potential to said coil.

2. An X-ray apparatus as set forth in claim 1 wherein said X-ray path defining means comprises a dividing member extending between said window of said X-ray shielding member and the exterior of said casing to prevent said insulating gas from entering said X-ray path.

3. An X-ray apparatus as set forth in claim 2 wherein said X-ray tube comprises a cylindrical metal member provided with an X-ray outlet in its mid-portion and having a grounded potential, said dividing member being connected to said cylindrical metal member, and a pair of insulators attached to the opposite ends, respectively, of said metal member and holding an anode and a cathode, respectively, therein.

4. An X-ray apparatus as set forth in claim 3 wherein at least one of said opposite ends of said cylindrical metal member is provided with a radially outwardly extending perpendicular flange on which said dividing member is supported.

5. An X-ray apparatus as set forth in claim 3 wherein said cylindrical metal member is provided with an O-ring groove or a sealing surface on its outer periphery.

6. An X-ray apparatus as set forth in claim 1 wherein said X-ray tube comprises an anode having a target therein, a cathode disposed opposite to said target, an insulator enclosing said cathode, and a flange lying perpendicularly to the longitudinal axis of said X-ray tube and connected to said casing so as to position said insulator within said casing and said anode outwardly of said casing.

7. An X-ray apparatus as set forth in claim 6 wherein said anode has a cylindrical configuration with a closed end, said target being obliquely positioned on the inner surface of said closed end, and said anode has a radiation window on an outgoing path of rays from said target and is provided with an integrally connected cooling fin device around its outer periphery.

8. An X-ray apparatus as set forth in claim 6 wherein said flange is constructed integrally with a boss and cooling fins clamped about said anode, and has a slit which extends along the longitudinal axis of said X-ray tube to be narrowed to clamp said boss about said anode.

9. An X-ray apparatus as set forth in claim 8 wherein said cooling fins comprise a plurality of each of radially disposed long and short fins, said long fins also serving as ribs for an outer frame.

10. An X-ray apparatus as defined in claim 6 wherein said flange has an X-ray shielding member which restricts the angle of emission of the X-rays directed by said target into the interior of said casing.

11. An X-ray apparatus as set forth in claim 9 wherein said outer frame has an inside diameter which is greater than the outside diameter of said casing, and defines an opening through which the air flowing past said cooling fins to cool them is guided to flow along the outer wall of said casing.

12. An X-ray apparatus as set forth in claim 8 wherein said boss has a small inside diameter portion contacting said anode intimately, and a large inside diameter portion which is contiguous to said small inside diameter portion and clamps said X-ray shielding member between said boss and said anode.

13. An X-ray apparatus as set forth in claim 1 wherein said electrodes are disposed on said stepped surface in such a manner as to eliminate any acute corner therefrom.

14. An X-ray apparatus according to claim 1, further comprising:

blower means for producing closed circulation of said insulating gas within said casing; and heat exchange means in communication with circulated insulating gas for extracting heat from said insulating gas.

15. An X-ray apparatus as set forth in claim 1 wherein said high voltage transformer comprises an iron core, a primary winding wound about said iron core, a secondary winding wound concentrically about said primary winding, and a tertiary winding disposed concentrically on one or both sides of said secondary winding.

16. An X-ray apparatus as set forth in claim 15 wherein said tertiary winding comprises two equal portions disposed on both sides of said secondary winding.

17. An X-ray apparatus as set forth in claim 15 wherein said iron core comprises a central core, a yoke, and an auxiliary core provided to increase an area of contact between said central core and said yoke.

18. An X-ray apparatus comprising:

a casing, filled with an insulating gas, a high voltage transformer in said casing, an X-ray tube mounted to said casing within said casing and connected to said transformer, an X-ray shielding member attached to the wall of said X-ray tube and defining a window through which the X-rays radially emitted by said X-ray tube are released in a predetermined direction, means defining an X-ray path through which said X-rays released through said window of said X-ray shielding member are directed so as not to be radiated on said insulating gas, said insulating gas surrounding and insulating said high voltage transformer and said X-ray tube, said X-ray path defining means preventing ionization of said insulating gas by preventing X-rays emitted through said window from impinging on said insulating gas, and said high voltage transformer comprising a ring-shaped iron core, a primary coil wound about a portion of said iron core, a spool passing through the center of said ring-shaped iron core and lying in a plane perpendicular to the plane of said iron core, and a secondary coil wound about said spool.

19. An X-ray apparatus as set forth in claim 18 wherein said secondary coil is secured to an outer wall of said X-ray tube on the anode side thereof.

* * * * *